US006471312B1

(12) United States Patent
Coffey et al.

(10) Patent No.: US 6,471,312 B1
(45) Date of Patent: Oct. 29, 2002

(54) BINDER BIN INCLUDING DAMPENING MECHANISM FOR DOOR

(75) Inventors: Jeffrey J. Coffey, Grand Rapids, MI (US); Richard S. Hand, Palo Alto, CA (US); Theodore M. Haan, Byron Center, MI (US); Russell T. Holdredge, Alto, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/533,772

(22) Filed: Mar. 23, 2000

(51) Int. Cl.[7] ..... A47B 88/00
(52) U.S. Cl. ..... 312/328; 312/319.2; 49/205
(58) Field of Search ..... 312/325, 326, 312/327, 328, 329, 319.1, 319.2, 319.4, 245; 49/40, 203, 204, 205

(56) References Cited

U.S. PATENT DOCUMENTS

| | | | | |
|---|---|---|---|---|
| 1,384,530 | A | 7/1921 | Knauft | 312/319.2 X |
| 1,879,798 | A | 9/1932 | Ferris | |
| 1,940,408 | A | 12/1933 | Ferris | |
| 2,129,221 | A | 9/1938 | Lewis | 49/205 |
| 2,745,147 | A | 5/1956 | Berry | |
| 3,308,581 | A | 3/1967 | Gustavsson | 49/205 |
| 3,545,132 | A | 12/1970 | Hormann et al. | 49/206 X |
| 3,990,542 | A | 11/1976 | Dent et al. | |
| 4,035,954 | A | 7/1977 | Hoff | |
| 4,167,298 | A | 9/1979 | Plattner | |
| 4,338,990 | A | 7/1982 | Blodee et al. | |
| 4,383,721 | A | 5/1983 | Knaack et al. | |
| 4,452,015 | A | 6/1984 | Jacques et al. | |
| 4,706,333 | A | 11/1987 | Lauderbach | |
| 4,815,797 | A | 3/1989 | Haab et al. | 312/322 |
| 4,966,403 | A | 10/1990 | Nordström | |
| 5,050,943 | A | 9/1991 | Barnett | |
| 5,172,969 | A | 12/1992 | Reuter et al. | 312/328 |
| 5,226,706 | A | 7/1993 | Tuller | 312/228 |
| 5,271,652 | A | 12/1993 | Watanabe et al. | |
| 5,323,569 | A | 6/1994 | Walz | 312/322 X |
| 5,372,175 | A | 12/1994 | Calhoun et al. | |
| 5,409,308 | A | 4/1995 | Reuter et al. | 312/319.4 |
| 5,524,979 | A | 6/1996 | Carson et al. | 312/319.2 |
| 5,645,333 | A | 7/1997 | Sakurai | 312/322 |
| 5,758,937 | A | 6/1998 | Lammens et al. | 312/328 |
| 5,845,980 | A | 12/1998 | Fricano et al. | 312/327 |
| 5,882,099 | A * | 3/1999 | Salice | 312/319.2 X |
| 6,227,635 | B1 * | 5/2001 | Teppo et al. | 312/328 |

FOREIGN PATENT DOCUMENTS

| | | | | |
|---|---|---|---|---|
| CH | 422573 | * 4/1967 | | 49/204 |
| DE | 2529477 | * 1/1977 | | 49/205 |
| SE | 313000 | * 7/1969 | | 49/204 |

* cited by examiner

*Primary Examiner*—James O. Hansen
(74) *Attorney, Agent, or Firm*—Price, Heneveld, Cooper, DeWitt & Litton

(57) ABSTRACT

A storage apparatus includes a storage unit defining a front opening, and a closure member configured to cover the front opening. The closure member is attached to the storage unit for movement between open, intermediate and closed positions. The storage apparatus further includes a dampening element operably coupled to the closure member and the storage unit. The dampening element provides enhanced resistance to the movement of the closure member during a final phase of the opening and closing movements of the closure member while not providing enhanced resistance during an initial phase of the opening and closing movements.

22 Claims, 4 Drawing Sheets

BINDER BIN INCLUDING DAMPENING MECHANISM FOR DOOR

BACKGROUND OF THE INVENTION

The present invention relates to a storage apparatus and, in particular, to a binder bin that includes a door with a dampening mechanism for controlling movement of the door.

Binder bins and similar storage apparatus are used in a wide variety of applications to store numerous items, particularly above desk and work areas. They have also been adapted to be attached to permanent structural walls and portable reconfigurable partitions. These storage apparatus typically include a forwardly open box-like bin suspended above the desk or work area by way of structural supports, and a door for closing the bin. The door of the storage bin is typically movable between an open and closed position by manually lifting the door. Unless the doors are counterbalanced, they may slam closed with a "guillotine-like" movement if released before they have moved to their fully opened or closed position. Some storage bins include dampening mechanisms that operate through the full motion of the associated door, thereby making the movement of the door inconvenient and cumbersome.

Accordingly, an apparatus. solving the aforementioned problems and having the aforementioned advantages is desired.

SUMMARY OF THE INVENTION

In one aspect of the present invention, a storage apparatus includes a storage unit defining a front opening, and a closure member configured to cover the front opening. The closure member is attached to the storage unit for movement between opened, intermediate and closed positions. The storage apparatus further includes a dampening element operably coupled to the closure member and the storage unit so that the dampening element provides enhanced resistance to movement of the closure member during a final phase of the opening and closing movements of the closure member but does not provide resistance to movement during an initial phase of the opening and closing movements.

Another aspect of the present invention is to provide a storage apparatus including a storage compartment structure defining an opening, and a closure member configured to cover the opening. The closure member is attached to the storage unit for movement between opened, intermediate and closed positions. The storage unit further includes a dampening element that includes a fluid cylinder having a first end and a second end, wherein the distance between the first end and the storage compartment structure is fixed and the distance between the second end and the closure member is fixed. The dampening element provides resistance to the movement of the closure member during a final phase of the opening and closing movements of the closure member while not providing enhanced resistance during an initial phase of the opening and closing movements.

Yet another aspect of the present invention is to provide a storage apparatus including a storage compartment structure defining an opening, and a closure member configured to cover the opening. The closure member is attached to the storage unit for movement between opened, intermediate and closed positions. The storage unit further includes a dampening element that includes a plate having an arcuate slot therein and a dampener attached to a selected one of the storage compartment structure and the closure member, and an engagement member attached to a selected one of the storage compartment structure and the closure element which is not attached to the plate and the dampener. The engagement member is operably engaged within the slot of the plate. The dampening element provides enhanced resistance to the movement of the closure member during a final phase of the opening and closing movements of the closure member while not providing enhanced resistance during an initial phase of the opening and closing movements.

An object of the present invention includes providing a storage cabinet that is easily operable between an opened, intermediate, and closed position by way of a dampening element that provides enhanced resistance to the movement of the door during a final phase of the opening and closing movements of the door while not providing enhanced resistance during the initial phase of the opening and closing movements. In addition, the storage cabinet may be easily retrofitted to be supported on existing structural supports, from permanent structural walls, or from free standing partition systems. The storage cabinet can be constructed of numerous materials such as plastic, metal, wood, composites, and the like.

These and other advantages of the present invention will be further understood and appreciated by those skilled in the art by reference to the following written specification, claims, and appended drawings.

DETAILED DESCRIPTION OF PREFERRED EMBODIMENT

Figure 1:
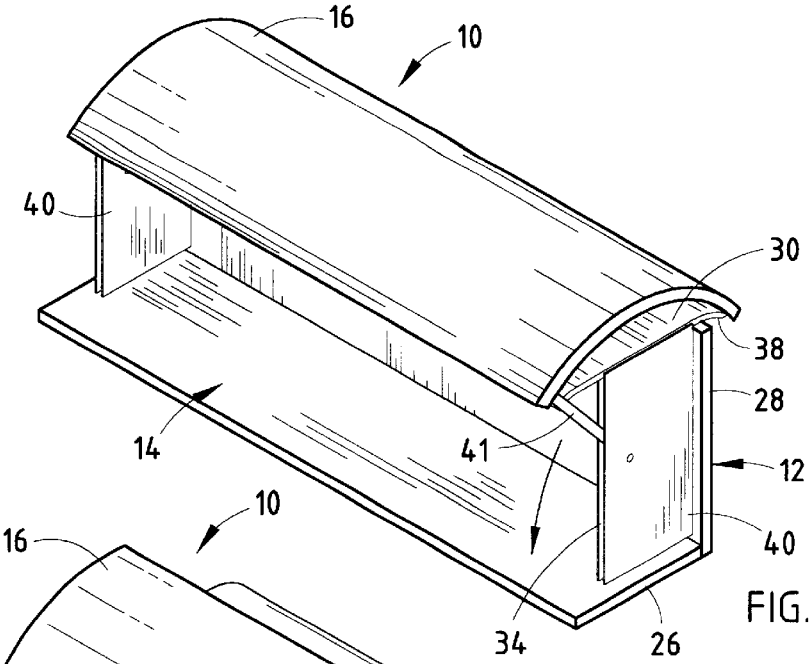
FIG. 1 is a perspective view of a storage apparatus embodying the present invention, with a door in an opened position.

For purposes of description herein, the terms "upper," "lower," "right," "left," "rear," "front," "vertical," "horizontal," and derivatives thereof shall relate to the invention as oriented in FIG. 1. However, it should be understood that the invention may assume various alternative orientations and step sequences, except where expressly specified to the contrary. It should also be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly stated otherwise.

Figure 2:
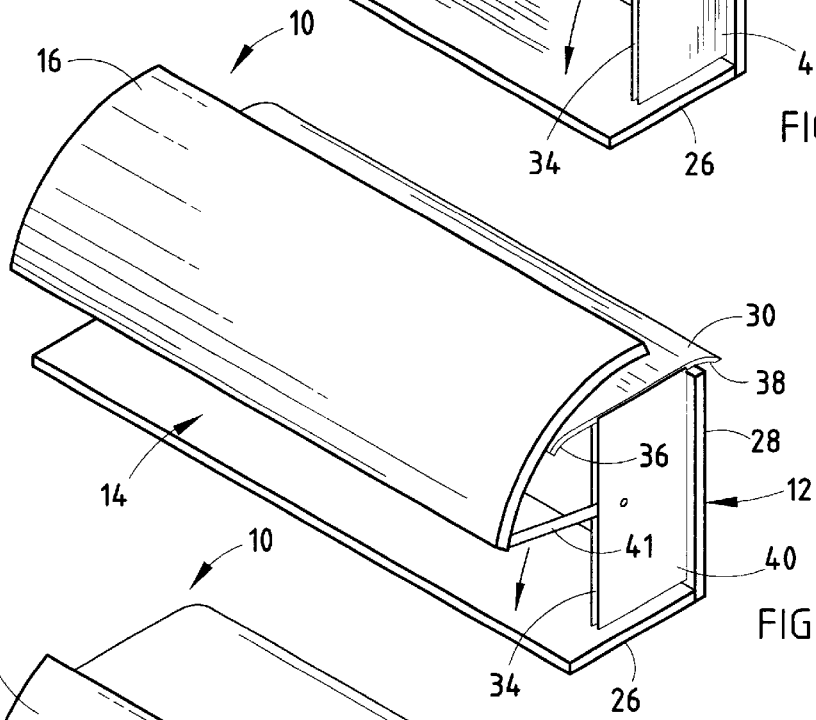
FIG. 2 is a perspective view of the storage apparatus with the door in an intermediate position.

Storage apparatus 10 (FIG. 1) embodies the present invention. Storage apparatus 10 includes a storage unit or bin 12 that defines a front opening 14, and a closure member or door 16 configured to cover front opening 14. Door 16 is operably attached to bin 12 for movement between opened, intermediate (FIG. 2), and closed (FIG. 3) positions. Storage unit 10 further includes a dampening element 18 (FIG. 4) that includes a fluid cylinder 20 having a first end 22 and a second end 24. Dampening element 18 is constructed and attached to storage unit 12 such that the distance between first end 22 of fluid cylinder 20 and storage unit 12 is fixed, and such that the distance between second end 24 of fluid cylinder 20 and door 16 is also fixed. Damping element 18 provides enhanced resistance to the movement of door 16 during a final phase of the opening and closing movements of door 16, and does not provide enhanced resistance during an initial phase of the opening and closing movements, thus providing door 16 with a slowed motion as door 16 approaches the final phase of the opening and closing movements.

The illustrated storage unit or bin 12 (FIG. 1) includes a bottom wall 26, a rear wall 28, a top wall 30, and side walls 40. Bin 12 may be constructed of numerous materials, including but not limited to plastics, metals, wood, composites, and the like, depending on the application. Top wall 30 is provided with a downwardly extending, arcuately shaped front edge 36, and a downwardly extending, arcuately shaped rear edge 38. Bottom wall 26 and rear wall 28 may be provided with connection devices (not shown), such as hooks or brackets, for attaching bin 12 to a structural support (not shown) extending above a desk or work area, or to a permanent structural wall or a free standing partition, depending on the application. Each side wall 40 is provided with a hollow interior 34.

The illustrated door 16 has an arcuate lateral cross-sectional shape substantially similar to the arcuate shape of front edge 36 and rear edge 38 of the top wall 30. The similar arcuate shapes of front edge 36, rear edge 38, and door 16, allow door 16 to track more closely to top wall 30 when moved between the closed and opened positions, thereby allowing a reduction of the overall space required by the storage apparatus 10. Door 16 is provided with two rigid arms 41 located at opposite ends thereof. Each arm 41 (FIG. 4) has a first end 42 attached to door 16, a second end 44 pivotally attached to second end 24 of fluid cylinder 20 at a pivot point 46, and an intermediate point located between first end 42 and second end 44 and pivotally attached to bin 12 at a pivot point 47. The door 16 is imbalanced in both the opening and closing directions. This imbalance forces the door 16 towards the opened or closed position when moved beyond the intermediate position in either direction.

Figure 3:
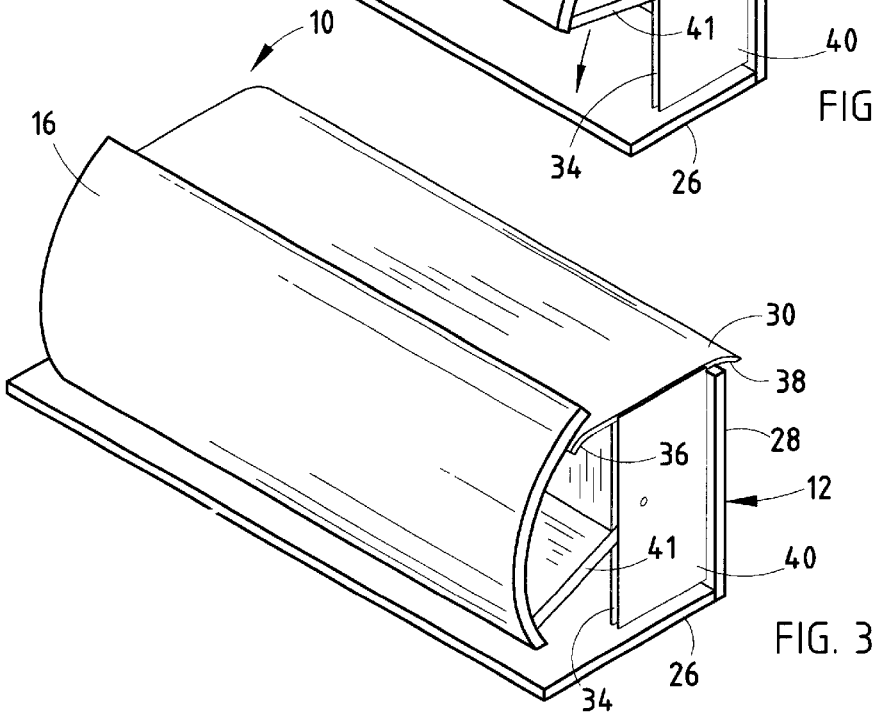
FIG. 3 is a perspective view of the storage apparatus with the door in a closed position.
Figure 4:
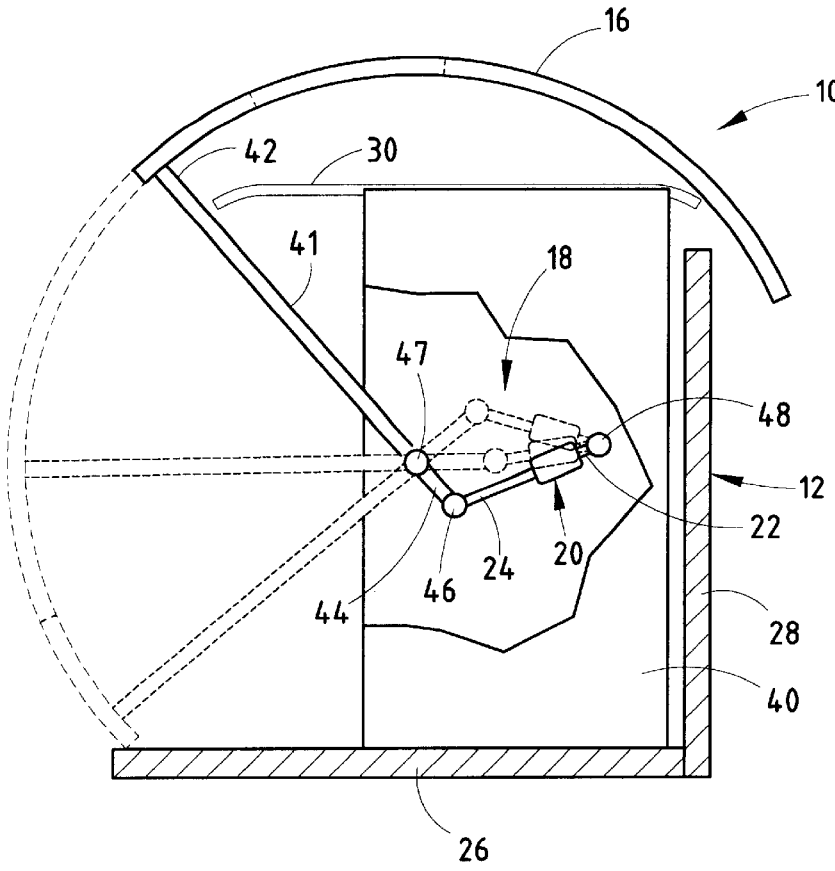
FIG. 4 is a cross-sectional, side elevational view of the storage apparatus taken along the line 44 in FIG. 1, with the door being shown in the opened position in solid lines, and the door being shown in the intermediate and closed positions in dashed lines.

First end 22 of fluid cylinder 20 is pivotally attached to bin 12 at a pivot point 48. In the illustrated example, a fluid cylinder 20 is a one-way gas damping cylinder, however, fluid cylinder 20 maybe provided in the form of a one-way, hydraulic damping cylinder. The geometry of fluid cylinder 20 is such that the maximum stroke velocity is achieved at the end of each stroke, thus providing maximum damping at the fully extended positions, which correspond to door 16 being in the fully opened position (FIG. 1) and the fully closed position (FIG. 3). As illustrated, fluid cylinder 20 should be approximately perpendicular to rigid arm 41 at the end of each stroke (i.e. when door 16 is in either the fully opened or fully closed positions). Fluid cylinder 20 does not provide damping during approximately the first half of the stroke in either direction, but rather begins providing damping at approximately the mid-stroke and increases damping up to a maximum at the end of each stroke.

Figure 5:
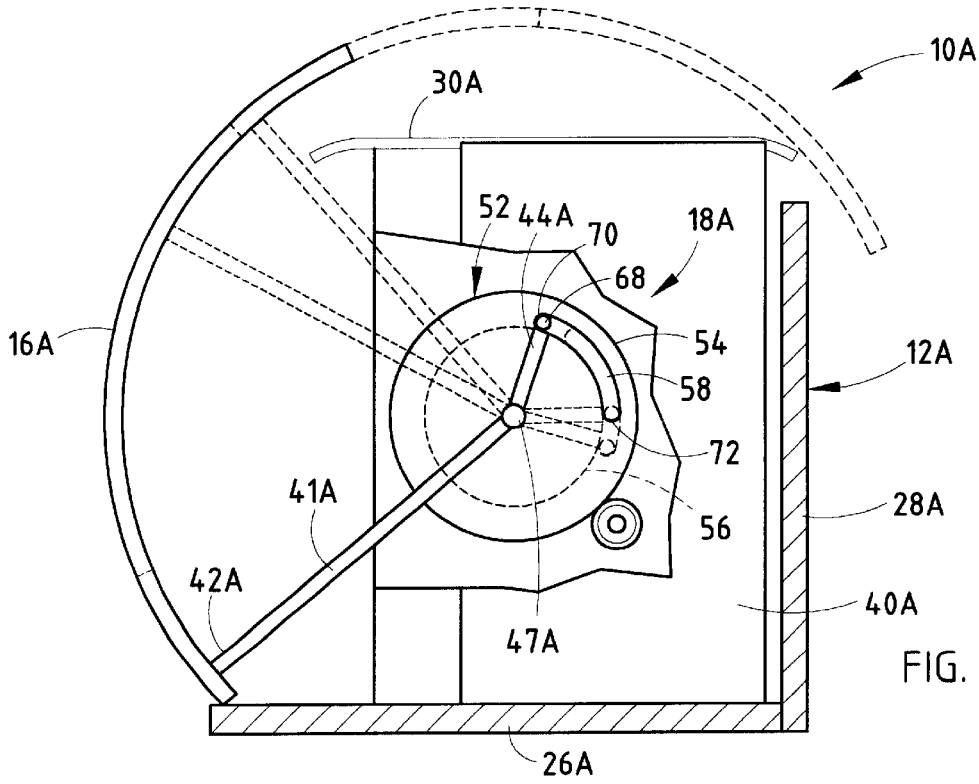
FIG. 5 is a cross-sectional, partially cut away, side elevational view of an alternative embodiment of the storage apparatus, the storage apparatus including a rotational viscous dampener and the door being shown in the closed position in solid lines, and the door being shown in the intermediate and open positions in dashed lines.
Figure 6:
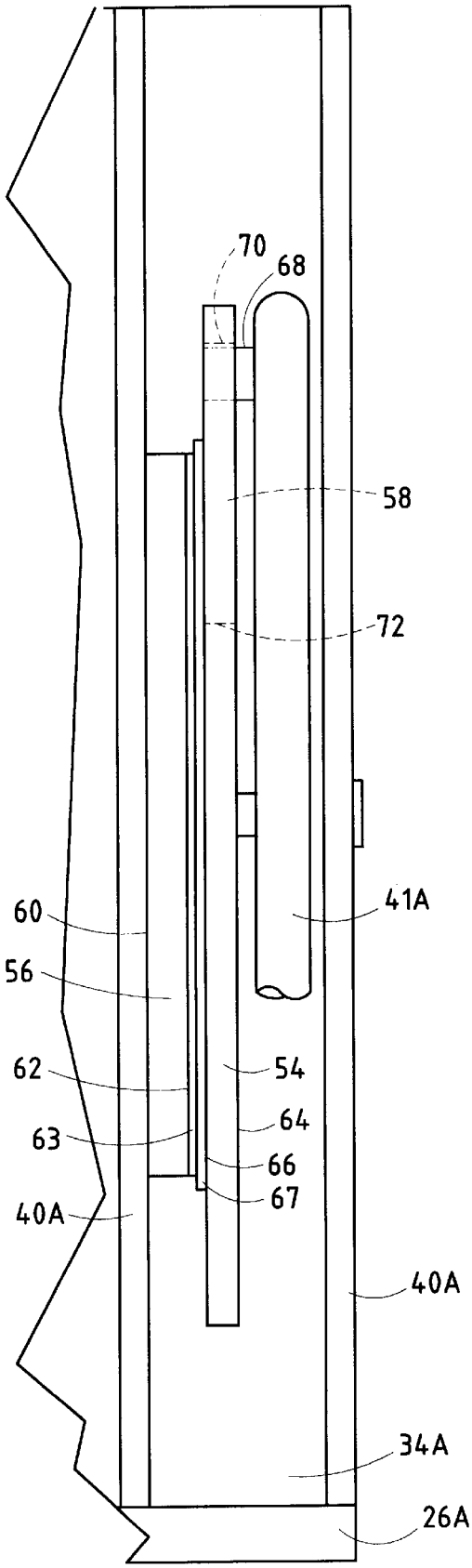
FIG. 6 is a partially cut away front view of the rotational viscous dampener.

The reference numeral 10A (FIGS. 5 and 6) generally designates another embodiment of the present invention having a dampening element 18A. Since storage apparatus 10A is similar to the previously described storage apparatus 10, similar parts appearing in FIGS. 1–4 and FIGS. 5 and 6, respectively, are represented by the same, corresponding reference numeral, except for the suffix "A" in the numerals of the latter.

Dampening element 18A of storage apparatus 10A includes a rotational viscous dampener 52. Viscous dampener 52 includes a circularly shaped damper 54 having an arcuately shaped slot 58 located therein, and a damper gear 56. Damper 54 is provided a first side 64 and an inwardly facing second side 66 that has a viscous 63 material such as silicon adhered thereto. Slot 58 is provided a first end 70 and a second end 72 and an arc of about 70 degrees. Notably, different arcs may be used to alter the dampening characteristics as discussed below. Damper gear 56 has a first side 60 fixably attached to a side wall 40A of bin 12A and a second side 62 having a viscous material 63 such as silicon adhered thereto.

Figure 7:
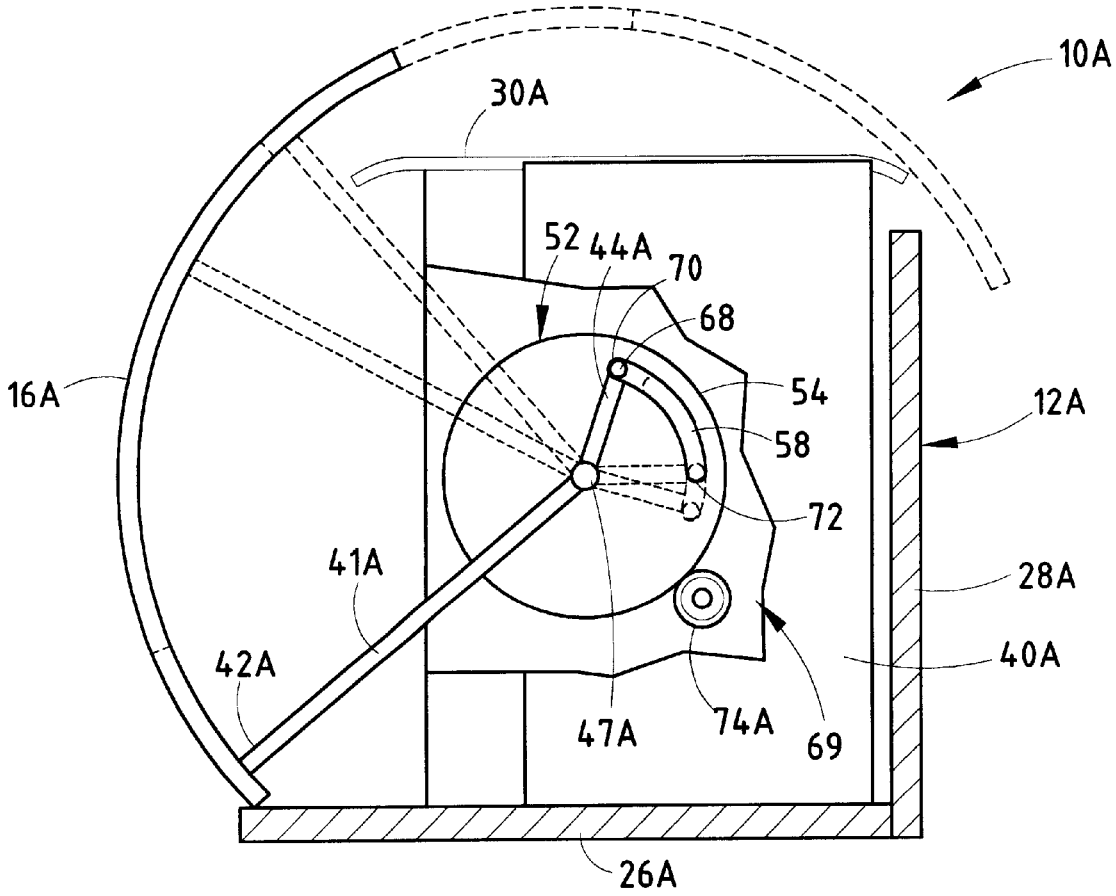
FIG. 7 is a cross-sectional, partially cut away, side elevational view of an alternative embodiment of the rotational viscous dampener, with the door being shown in the closed position in solid lines, and the intermediate and open positions in dashed lines.

Alternatively, an alternative rotational viscous dampener 69 (FIG. 7) can be used. Viscous dampener 69 includes a wheel 74 that is pivotally attached to sidewall 40A such that it is difficult to rotate. Viscous dampener 69 is in rotatable contact with dampener 54 causing a frictional lock therebetween, such that rotating dampener 54 forces viscous dampener 69 to rotate. The contact between viscous dampener 69 and dampener 54 dampens the rotational movements of dampener 54 and thus door 10A. In operation, viscous dampener 69 acts similarly to viscous dampener 18A when door 16A is rotated between the opened and closed positions.

Door 16A is provided with two rigid arms 41A located at opposite ends thereof, each having a first end 42A, a second end 44A, and a intermediate point located between first end 42A and second end 44A and is pivotally attached to side walls 40A of bin 12A at a pivot point 47A. Each arm 41A is provided with a slight bend at the intermediate pivot point 47A. First end 42A of each rigid arm 41A is fixedly attached to door 16A. Second end 44A of each rigid arm 41A is provided with a pin 68 which is received within slot 58 of damper 54.

In operation, each rigid arm 41A pivots about pivot point 47A as door 16A is moved between the closed and opened positions, thereby causing pin 68 attached to second end 44A of each rigid arm 41A to track within slot 58. As illustrated, door 16A rotates through about a 90° angle when rotated between the fully closed and fully opened positions. When pin 68 reaches first end 70 of slot 58, pin 68 forces damper gear 56 to rotate relative to damper 54. Since the arc of slot 58 is approximately 70°, while door 16A can rotate through a motion of 90°, friction between damper 54 and damper gear 56 dampens the motion of door 16A when pin 68 forces damper gear 56 to rotate relative to damper 54, or, as in the illustrated example, through the final 20° of rotation of door 16A. This configuration thereby provides dampening of the motion of door 16A through the final 20° of motion in both the opening and closing directions.

The inventive storage apparatus described herein provides a greatly improved structure for operating the associated door 16 between the closed, intermediate, and opened positions, by providing enhanced resistance to the movement of door 16 during the final phase of the closing and opening movements of the door 16 while allowing free and easy movement of door 16 during an initial phase of the closing and opening movements. In addition, the configuration and construction of storage apparatus results in a low cost, easy to build, and easy to fix overhead storage unit, and one that is easily adjustable to adapt to many existing bin supports, permanent structural walls, and reconfigurable/portable partition systems.

In the foregoing description it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage apparatus comprising:

a storage unit defining a front opening;

a closure member configured. to cover the front opening and attached to the storage unit for movement between opened, intermediate and closed positions; and a dampening element operably coupled to the closure member and the storage unit, wherein the dampening element provides enhanced resistance to the movement of the closure member during a final phase of the opening and closing movements of the closure member while not providing enhanced resistance during an initial phase of the opening and closing movements.

2. The storage apparatus described in claim 1, wherein the closure member is pivotally mounted to the storage unit.

3. The storage apparatus described in claim 2, wherein the storage unit is adapted to be mounted above a work surface.

4. The storage apparatus described in claim 2, wherein the storage unit is adapted to be mounted on a partition system.

5. The storage apparatus described in claim 2, wherein the dampening element includes a fluid cylinder having a first end and a second end, and wherein the distance between the first end and the storage unit is fixed and the distance between the second end and the closure member is fixed, thereby providing the enhanced resistance to the movement of the closure member.

6. The storage apparatus described in claim 2, wherein the dampening element includes a plate having an arcuate slot therein and a dampener attached to a selected one of the storage compartment structure and the closure member, and an engagement member attached to a selected one of the storage compartment structure and the closure element not attached to the plate and the dampener, and wherein the engagement member is operably engaged within the slot of the plate, thereby providing the enhanced resistance to the movement of the closure member.

7. The storage apparatus described in claim 6, wherein the slot forms an arc of about 70° while the closure member pivots through an arc of about 90°.

8. A storage apparatus comprising:

a storage unit defining a front opening and adapted to be mounted on a storage unit;

a closure member configured to cover the front opening and pivotally attached to the storage unit for movement between opened, intermediate and closed positions;

a dampening element operably coupled to the closure member and the storage unit, wherein the dampening element includes a fluid cylinder having a first end and a second end, the distance between the first end and the unit structure is fixed and the distance between the second end and the closure member is fixed wherein the dampening element provides enhanced resistance to the movement of the closure member during a final phase of the opening and closing movements of the closure member while not providing enhanced resistance during an initial phase of the opening and closing movements; and a rigid arm having a first end attached to the closure element, a second end attached to the second end of the fluid cylinder, and a midpoint located between the first and second ends of the rigid arm and pivotally attached to the storage unit, and wherein the first end of the fluid cylinder is pivotally attached to the storage unit.

9. The storage apparatus described in claim 8, wherein the fluid cylinder includes a gas cylinder.

10. A storage apparatus comprising:

a storage compartment structure defining an opening;

a closure member configured to cover the opening and attached to the storage compartment structure for movement between opened, intermediate and closed positions; and a dampening element including a fluid cylinder having a first end and a second end, wherein the distance between the first end and the storage compartment structure is fixed and the distance between the second end and the closure member is fixed, and wherein the dampening element provides enhanced resistance to the movement of the closure member during a final phase of the opening and closing movements of the closure member while not providing enhanced resistance during an initial phase of the opening and closing movements.

11. The storage apparatus described in claim 10, wherein the closure member is pivotally mounted to the storage compartment structure.

12. The storage apparatus described in claim 10, wherein the storage compartment structure is adapted to be mounted above a work surface.

13. The storage apparatus described in claim 10, wherein the storage compartment structure is adapted to be mounted on a partition system.

14. The storage apparatus described in claim 10, wherein the fluid cylinder includes a gas cylinder.

15. A storage apparatus comprising:

a storage compartment structure defining an opening;

a closure member configured to cover the opening and pivotally attached to the storage compartment structure for movement between opened, intermediate and closed positions;

a dampening element including a fluid cylinder having a first end and a second end, wherein the distance between the first end and the storage compartment structure is fixed and the distance between the second end and the closure member is fixed, and wherein the dampening element provides enhanced resistance to the movement of the closure member during a final phase of the opening and closing movements of the closure member while not providing enhanced resistance during an initial phase of the opening and closing movements; and a rigid arm having a first end attached to the closure element, a second end attached to the second end of the fluid cylinder, and an intermediate position between the first and second ends of the rigid arm and pivotally attached to the storage compartment structure, and wherein the second end of the fluid cylinder is pivotally attached to the storage compartment structure.

16. The storage apparatus described in claim 15, wherein the storage compartment structure is adapted to be mounted above a work surface.

17. The storage apparatus described in claim 16, wherein the storage compartment structure is adapted to be mounted on a partition system.

18. The storage apparatus described in claim 17, wherein the fluid cylinder includes a gas cylinder.

19. A storage apparatus, comprising:

a storage unit defining a front opening;

a closure member configured to cover the front opening and attached to the storage unit for movement between opened, intermediate and closed positions; and a means for dampening operably coupled to the closure member and the storage unit, wherein the means for dampening provides enhanced resistance to the movement of the closure member during a final phase of the opening and closing movements of the closure member while not providing enhanced resistance during an initial phase of the opening and closing movements.

20. The storage apparatus described in claim 19, wherein the closure member is pivotally mounted to the storage unit.

21. The storage apparatus described in claim 20, wherein the storage unit is adapted to be mounted above a work surface.

22. The storage apparatus described in claim 20, wherein the storage unit is adapted to be mounted on a partition system.

* * * * *